US007410012B2

(12) United States Patent
Li

(10) Patent No.: US 7,410,012 B2
(45) Date of Patent: Aug. 12, 2008

(54) HYDRAULIC AUTOMATIC BOOSTING PUMP

(75) Inventor: Hongmin Li, Beijing (CN)

(73) Assignee: Petrochina Company Limited, Beijing (CN)

( * ) Notice: Subject to any disclaimer, the term of this patent is extended or adjusted under 35 U.S.C. 154(b) by 425 days.

(21) Appl. No.: 10/508,157

(22) PCT Filed: Mar. 17, 2003

(86) PCT No.: PCT/CN03/00192

§ 371 (c)(1),
(2), (4) Date: Sep. 17, 2004

(87) PCT Pub. No.: WO03/078837

PCT Pub. Date: Sep. 25, 2003

(65) Prior Publication Data

US 2005/0142015 A1 Jun. 30, 2005

(30) Foreign Application Priority Data

Mar. 18, 2002 (CN) ..... 02 2 04123

(51) Int. Cl.

| | |
|---|---|
| ***F04B 17/00*** | (2006.01) |
| ***F04B 35/00*** | (2006.01) |
| ***E21B 7/18*** | (2006.01) |
| ***E21B 43/114*** | (2006.01) |

(52) U.S. Cl. ..... 175/67; 417/393; 417/531

(58) Field of Classification Search ..... 417/555.1, 417/453, 451, 393, 396, 531; 175/67, 212; 173/60

See application file for complete search history.

(56) References Cited

U.S. PATENT DOCUMENTS

| | | | | |
|---|---|---|---|---|
| 2,307,566 | A * | 1/1943 | Browne | 417/393 |
| 2,925,782 | A * | 2/1960 | Sharpe et al. | 417/345 |
| 3,048,115 | A * | 8/1962 | Musser | 417/393 |
| 3,057,417 | A * | 10/1962 | Sandvig | 175/212 |
| 5,787,998 | A * | 8/1998 | O'Hanlon et al. | 175/67 |

FOREIGN PATENT DOCUMENTS

| | | |
|---|---|---|
| CN | 1099456 A | 3/1995 |
| CN | 1110374 A | 10/1995 |
| CN | 1121979 A | 5/1996 |
| SU | 742575 | 6/1980 |

* cited by examiner

*Primary Examiner*—Devon Kramer
*Assistant Examiner*—Peter J Bertheaud
(74) *Attorney, Agent, or Firm*—Rothwell, Figg, Ernst & Manbeck P.C.

(57) ABSTRACT

A hydraulic automatically-pressurizing pump comprises an intermediate fastening connector, a reversing valve, a mechanically-controlled automatic direction-reversing device, a power cylinder, a pressurizing cylinder and an ultra-high-pressure connecting tube which are disposed in series in a case and assembled from the upper end to the lower end along a central axes of the case. The fastening connector is connected with the case and further connected through pressure with the reversing valve. The power cylinder is a multi-stage power cylinder. The pressurizing cylinder communicates with a two-channel drill bit through the ultrahigh-pressure connecting tube, and an ultrahigh-pressure channel is provided on the wall of the pressurizing cylinder. The core of the reversing valve is connected with the mechanically-controlled automatic direction-reversing device. The present invention is suitable for a pressurizing pump for large-discharge drilling wells, which can efficiently increase the drilling speed, reduce the cost for the whole machine.

14 Claims, 3 Drawing Sheets

HYDRAULIC AUTOMATIC BOOSTING PUMP

FIELD OF THE INVENTION

The present invention relates to an under-well automatically-pressurizing device, particularly to a hydraulic automatically-pressurizing pump.

BACKGROUND OF THE INVENTION

At present, in the process of conventional well-drilling, the drilling pressure is mainly applied directly by the drilling machine to drive a drill to crush rocks, and a ground mud pump is used to inject well-drilling liquid to clean the well bottom and bring up rock bits. This kind of well-drilling method consumes a large amount of energy but produces a low efficiency, and it costs much for the same drilled depth, which causes great problems especially in the case of a deep well. In the patent No.EP06645A1, due to the defect in structure that the elongated position-limiting rod of the reversing valve moves synchronously with the power cylinder, the pressurizing pump must be lengthened a length of 3 strokes. Although the US Flow Drill utilizes a conventional dual-cylinder dual-action pressurizing method to realize a continuous bi-directional discharge of ultrahigh-pressure liquid, a 3-stage pressure-charging must be employed if an ultrahigh-pressure rock-crushing and well-drilling is required. Thus, the whole length of the pump must be at least 5 m and the velocity of it must be about 1.5 m/sec, which make the whole machine have longer length, complex structure, high costs and a shorter life time.

SUMMARY OF THE INVENTION

The object of the present invention is to provide a hydraulic automatically-pressurizing pump which has shorter length, low velocity, simple structure, high direction-reversing sensitivity and longer life time.

The above object is realized by providing a hydraulic automatically-pressurizing pump, comprising an intermediate fastening connector, a case, a reversing valve, a mechanically-controlled automatic direction-reversing device, a power cylinder, a pressurizing cylinder and an ultrahigh-pressure connecting tube. The reversing valve, mechanically-controlled automatic direction-reversing device, one-stage or multi-stage power cylinder, pressurizing cylinder and ultrahigh-pressure connecting tube are disposed in series in the case. The fastening connector is connected with the case and further connected through pressure with the reversing valve and the pressurizing cylinder successively.

The present invention provides a hydraulic automatically-pressurizing pump in which said power cylinder disposed in the case is a multi-stage power cylinder.

Said pressurizing cylinder is connected with a two-channel drill bit through the ultrahigh-pressure connecting tube which is in the center of the case and an ultrahigh-pressure channel is provided on the wall of the pressurizing cylinder.

A section of enlarged shoulder hole which is a thin-wall tube is disposed in the ultrahigh-pressure connecting tube.

A plug-in reversing valve with a pilot valve is optional. The plug-in reversing valve (a cone-shaped valve) is connected with the upper end of the pilot valve. The control channel of the plug-in reversing valve is connected with the outlet of the pilot valve flow channel, and the main flow channel of the plug-in reversing valve communicates with the power cylinder though the pilot valve.

The core of the reversing valve (or the pilot valve) is connected with the mechanically-controlled automatic direction-reversing device.

The mechanically-controlled automatic direction-reversing device comprises an elongated rod with a through hole in the center, a position-limiting sleeve and a spring element which are provided at the end of the elongated rod.

The reversing valve is a two-position four-way reversing valve with a positioning mechanism provided in the valve core. The upper cavity S of the valve core with a central through hole communicates with the well eye through a check discharge valve. Small holes disposed in the valve core communicate with an annular space X formed by the valve body and the elongated rod and communicate with the central through hole of the valve core and that of the elongated rod.

Position-limiting shoulders are provided at the upper and lower ends in the hole of the hollow piston rod of the first-stage power cylinder, respectively.

Small holes for forming flow channels which permit liquid to reach the lower cavity of the power cylinder are provided longitudinally on the wall of the power cylinder, while small holes for forming flow channels which permit liquid to reach the upper cavity of the second or further stage power cylinders are provided longitudinally on the wall of the hollow piston rod of the power cylinder.

An inlet check valve is provided at the lower end of the pressurizing cylinder. And a discharge check valve is disposed in the center of the lower end of the piston in the pressurizing cylinder.

The piston rod of the pressurizing cylinder has the same diameter as the piston rod in the lower cavity of the last stage power cylinder.

A side flow channel is disposed between the reversing valve, the pilot valve, the power cylinder, the pressurizing cylinder and the case, which makes the pressurized mud fluid from the ground mud pump be ejected from an ordinary nozzle of the two-channel drill bit directly.

Furthermore, a check discharge valve is provided at one side or both sides of said reversing valve.

A filtering net is provided at the inlet of the reversing valve and the pressurizing cylinder respectively.

A check valve is provided at the upper end of the ultrahigh-pressure connecting tube. And a check valve is provided at the lower end of the side flow channel.

The present invention is suitable for a pressurizing pump for large-discharge drilling wells, which can efficiently increase the area of the power cylinder, reduce the velocity of the power cylinder and the pressurizing cylinder, shorten the length of the whole machine, enhance the reversing sensitivity, increase the life time and reduce the cost for the whole machine. It provides conditions for the improvement of the drilling speed and the reduction of the drilling cost.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
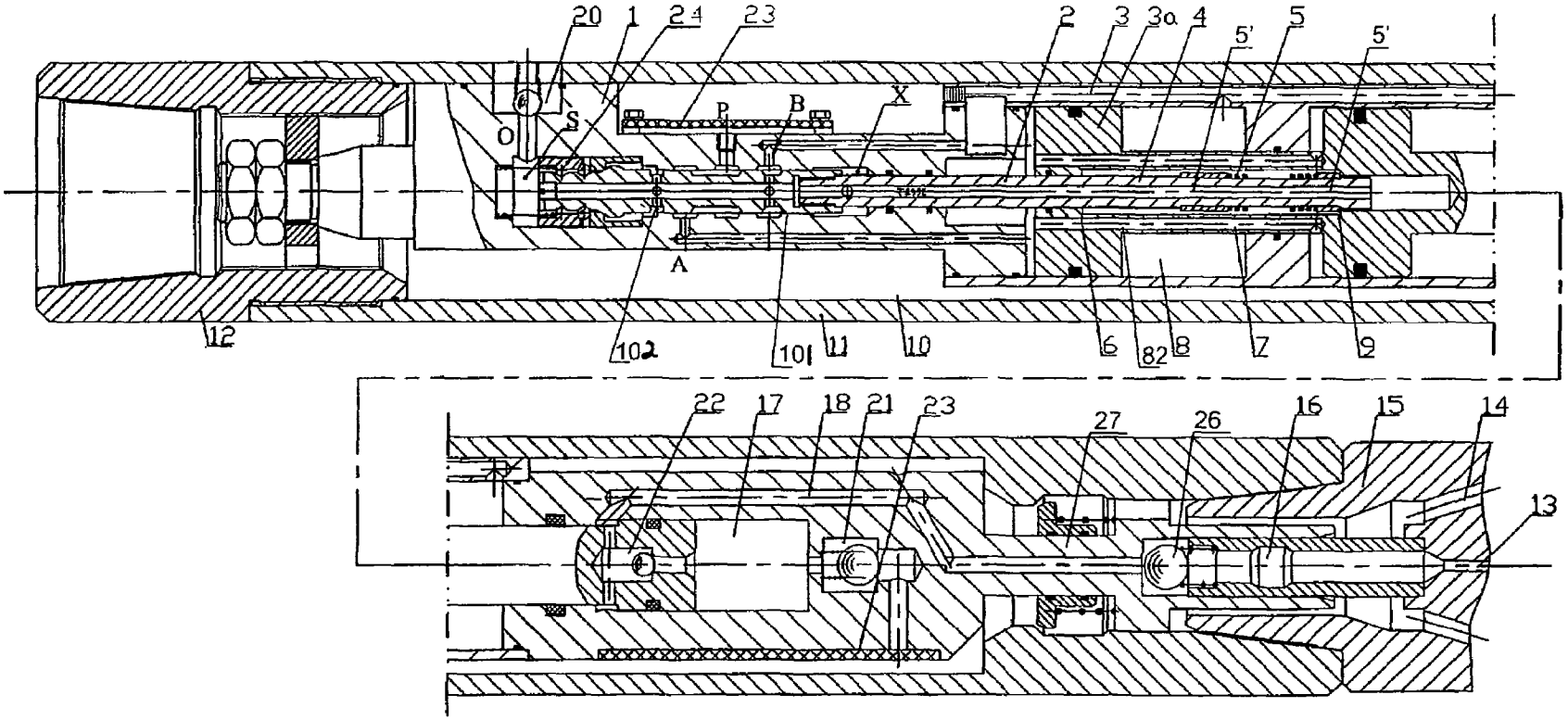
FIG. 1 is a schematic view of the structure of the present invention.

As shown in FIG. 1,the hydraulic automatically-pressurizing pump of the present invention makes use of the part flow from the ground mud pump entering a power cylinder through a reversing valve as power, while the majority is ejected from the ordinary nozzle through a side flow channel in pressurizing cylinder. Its pressurizing structure comprises a case 11, a reversing valve 1, a mechanically-controlled automatic direction-reversing device 2, a power cylinder 8, a pressurizing cylinder 17, and an intermediate fastening connector 12, wherein the reversing valve 1, the mechanically-controlled automatic direction-reversing device 2, the one-stage or multi-stage power cylinder 8, and the pressurizing cylinder 17 are disposed successively in the case 11 and assembled from the upper end to the lower end along a central axes I-I of the case 11, the fastening connector 12 is connected through pressure with the reversing valve 1 and a ultrahigh-pressure flow channel 18 is provided on the wall of the pressurizing cylinder 17.

During operation, the pressurizing cylinder 17 is connected with the nozzle flow channel 13 in the two-channel drill bit 15 through the ultrahigh-pressure connecting tube 16. There is a section of enlarged shoulder hole in the central hole of the ultrahigh-pressure connecting tube, which is essentially a thin-wall tube. The above reversing valve 1 is provided with a valve core 101, which is connected with the mechanically-controlled automatic direction-reversing device 2. The mechanically-controlled automatic direction-reversing device 2 mainly comprises an elongated rod with a through hole in the center, a spring element 5 and a position-limiting sleeve 5' which are provided at the end of the elongated rod. The reversing valve changes direction when the piston 3*a* moves to the end of the stroke limit of the power cylinder and compresses the spring element 5 at the end of the elongated rod (by means of the position-limiting sleeve 5'), and a reciprocating movement of the pressurizing cylinder is automatically realized. When the piston 3*a* begins to move downward, the elongated rod keeps still first, and then the position-limiting shoulder 6 touches the rod position-limiting sleeve 5' and compresses the spring 5 when the piston 3*a* moves to a predetermined distance, and finally the elongated rod 4 is pulled to move downward, driving the reversing valve core to move downward to realize the reverse of direction.

The reversing valve 1 can be a two-position four-way slide valve. The valve core 101 is provided with a positioning mechanism 24. A through hole in the center of the valve core 101 communicates with the cavity S and further communicates with the well eye through a check discharge valve 20. Small holes 102 disposed in the valve core 101 communicate with an annular space X formed by the valve body and the elongated rod and communicate with the central through hole of the valve core 101 and that of the elongated rod 4. A check discharge valve 20 is provided at one side or both sides of said reversing valve 1.

The mechanically-controlled automatic direction-reversing device 2 comprises an elongated rod 4 with a through hole in the center, a spring element 5 and a position-limiting sleeve 5' which are provided at the end of the elongated rod 4. Position-limiting shoulders 6/9 are provided at the upper and lower ends in the hole 82 of the hollow piston rod of the first-stage power cylinder 8, respectively. Small holes for forming a flow channel 3 which permits the liquid flow to the lower cavity of the power cylinder 8 is provided longitudinally on the wall of the power cylinder 8. Small holes are disposed longitudinally on the wall of the hollow rod of the power cylinder 8, which form a flow channel 7 for the flow to reach the upper cavity of the second stage or the further stage power cylinders. The position of the small holes make the area of the flow channel larger than that of the ordinary pump, and reduce the effect of the effective area of the pressurizing cylinder. An inlet check valve 21 is disposed at the lower end of the pressurizing cylinder 17, and a discharge check valve 22 is disposed in the center of the piston. The piston rod of said pressurizing cylinder 17 has the same diameter as the piston rod in the lower cavity of the last stage power cylinder. The pressurized mud fluid from the ground mud pump can enter directly into an ordinary nozzle of a two-channel drill bit through a side flow channel 10 which is provided between the reversing valve 1 and the case 11 and also the pressurizing cylinder 17 and the case 11, and further through an ordinary nozzle channel 14. A filtering net 23 is provided at the inlet of the reversing valve and the pressurizing cylinder respectively. A check valve 26 is provided at the upper end of the ultrahigh-pressure connecting tube and a check valve 27 is provided at the lower end of the side flow channel, which both can prevent mud from pouring into the pump as the pump enters the well.

Another embodiment (shown in FIG. 2, FIG. 3) of the present invention is to utilize a plug-in reversing valve 19 and a pilot valve 25 which are assembled together when the pump flow is large. The plug-in reversing valve 19 is connected with the upper end of the pilot valve 25, the control channel of which is connected with the outlet of the pilot valve flow channel. The main flow channel 'a' of the plug-in reversing valve communicates with the power cylinder through the flow channel 'a" of the pilot valve. The plug-in reversing valve 19 is connected with the pilot valve 25 through screws. As the plug-in reversing valve 19 and the pilot valve 25 are longitudinally arranged in the full of the case, the diameter of the plug-in reversing valve 19 and the pilot valve 25 is larger than that of the ordinary pump. The pressurized mud fluid from the ports A and B of the pilot valve controls the direction-reversing of the plug-in reversing valve 19. The plug-in reversing valve 19 is of a two-position four-way structure of a conic valve core, whose four control ports for the valve core communicate with the ports A and B of the pilot valve respectively. The ports A/B communicate with the central through hole of the pilot valve. The pressurized mud fluid enters the upper and lower cavities of the power cylinder through the valve cores C and D controlled by the ports C1 and D1, while the discharged mud fluid from one of the power cylinder cavities is drained into the well space through the valve cores E and F opened by the controlling of the ports C1 and D1 and further through the check discharge valve 20.

Figure 2:
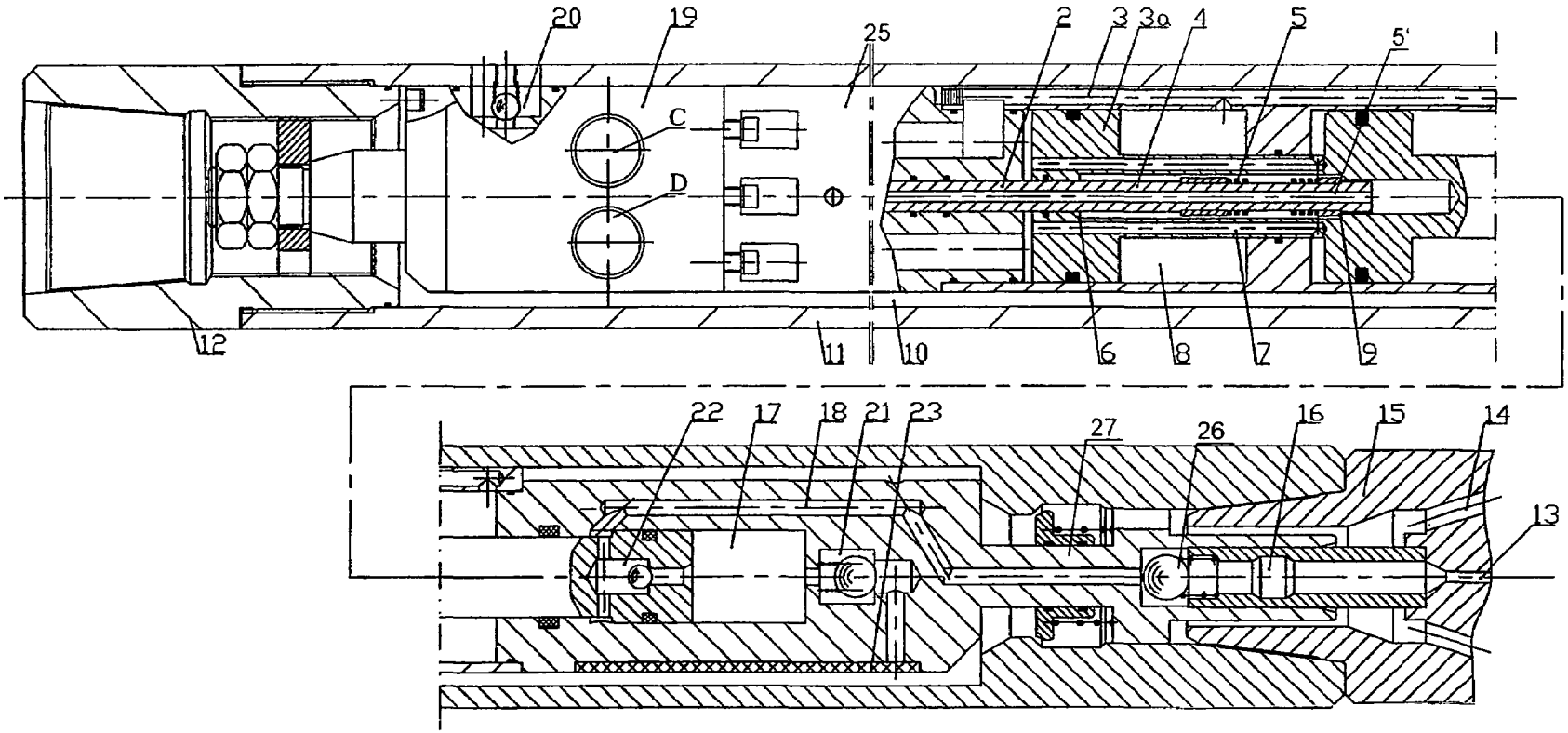
FIG. 2 is a schematic view of the structure of an embodiment connected with a plug-in reversing valve.
Figure 3:
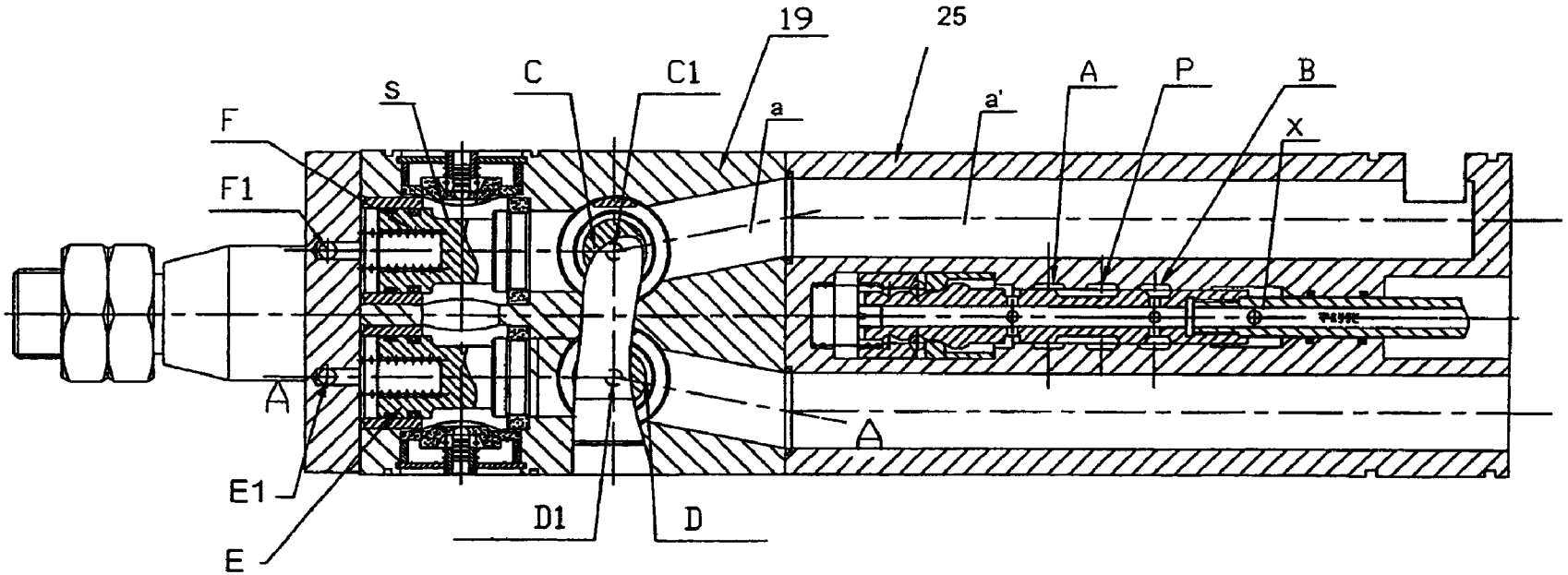
FIG. 3 is an enlarged view of the structure shown in FIG. 2.
Figure 4:
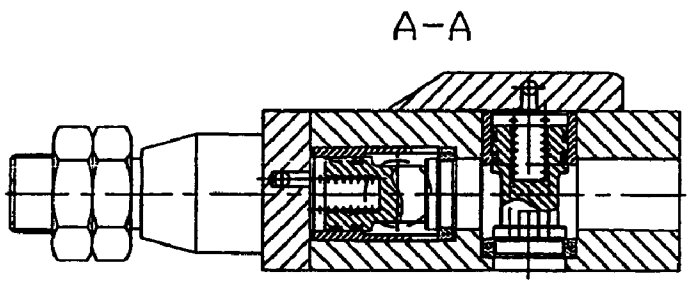
FIG. 4 is a section view of the structure along line A-A shown in FIG. 3.

The present invention operates as follows:

During operation, the upper end of the hydraulic automatically-pressurizing pump of the present invention connects with the drill bit spindle through a matched by-path valve assembly E1/F1, and its lower end connects with the two-channel drill bit 15. The ground mud pump provides slurries of 20 Mpa, which is divided into two ways when entering the pressurizing pump: about one third of the flow entering the reversing valve 1 (as shown in FIG. 1) or the plug-in reversing valve 19 (as shown in FIG. 2), and about two thirds of the flow entering the ordinary nozzle 14 of the two-channel drill bit through the side channel 10. Thus, comparing with the ordinary pump, the invention can reduce the velocity of the power cylinder 8 and increase the life time of the pressurizing cylinder 17. At the same time, the shunted flow from the side channel 10 enters the pressurizing cylinder 17 through a self-cleaning filtering device at the outer edge of the pressurizing cylinder. During the movement of the power cylinder 8, when the piston approaches its end point, the power cylinder 8 brings the mechanically-controlled automatic direction-reversing device 2 into movement and causes the reversing valve 1 to reverse directions (if the plug-in reversing valve with a pilot valve as shown in FIG. 2 is utilized, the pilot valve 25 is driven to reverse directions and then causes the plug-in reversing valve to reverse directions.). If the mud fluid from the main flow channel of the reversing valve 1 enters directly the upper cavity of the first stage power cylinder 8, and enters the upper cavity of the second stage cylinder of the power cylinder 8 through the flow channel 7 on the hollow piston rod, the mud fluid in the lower cavity of the first and the second stage power cylinder 8 is drained into the annular space between the drilling apparatus and the well hole through the flow channel 3 on the wall of the power cylinder, the reversing valve 1, and the check discharge valve 20 on the reversing valve. If the mud fluid from the reversing valve 1 enters the lower cavity of the first and the second stage power cylinder 8 through the flow channel 3 on the wall of the power cylinder, the discharged mud fluid will be drained into the annular space between the drilling apparatus and the well hole through the channel 7 on the wall of the hollow piston rod, the channels in the plug-in reversing valve 19 or the reversing valve 1 and the check discharge valve. When the piston of the power cylinder 8 moves upward, it drives the piston of the pressurizing cylinder to move up synchronously. Then, the mud fluid from the side flow channel 10 enters the lower end of the pressurizing cylinder 17 through the inlet check valve 21 at the lower end. At the same time, the check valve for liquid drainage 22 in the center of the piston of the pressurizing cylinder 17 is closed. The mud fluid between the piston rod and the inner diameter of the pressurizing cylinder 17 flows though the ultrahigh-pressure channel 18 on the wall of the pressurizing cylinder 17 and the check valve 26 at the upper end of the ultrahigh-pressure connecting tube 16, and finally is ejected from the ultrahigh-pressure nozzle 13 of the two-channel drill bit. When the piston of the power cylinder 8 moves downward, the inlet check valve 21 at the lower end of the pressurizing cylinder 17 closes automatically and the check valve for liquid drainage 22 is opened. As the volume of the lower cavity of the pressurizing cylinder 17 is becoming smaller, the excessive mud fluid is drained from the ultrahigh-pressure flow channel, and finally ejected from the ultrahigh-pressure nozzle 13. As the flow of the ground mud pump can directly enter into the nozzle 13, the pressure drop of the nozzle 13 will usually larger than 3.15 Mpa. So it can increase the cleaning condition while increasing the drilling speed.

APPLICATIONS IN INDUSTRY

The operation of the present invention is based on the principle that a larger area is used to push forward a smaller area to increase the pressure at the cost of a flow loss. The multi-stage power cylinder is to increase the total area of the power cylinder to increase the pressurization ratio, reduce the velocity and lower the operating frequency of the reversing valve and the control device so as to increase the life time of the pressurizing pump while increasing the drilling speed and finally reduce the drilling cost.

Although the invention has been described herein with reference to the preferred embodiments, it will be appreciated by those skilled in the art that changes and modifications may be made thereto without departing from the invention in its broader aspects and as set forth in the following claims.

What is claimed is:

1. A hydraulic automatically-pressurizing pump comprising:

an intermediate fastening connector;

a case;

a reversing valve;

a mechanically-controlled automatic direction-reversing device;

a power cylinder;

a pressurizing cylinder; and an ultrahigh-pressure connecting tube;

wherein the reversing valve, the mechanically-controlled automatic direction-reversing device, the power cylinder, the pressurizing cylinder and the ultrahigh-pressure connecting tube are disposed in series in the case and assembled from the upper end to the lower end along a central axis of the case, a valve core of the reversing valve is connected with one end of the mechanically-controlled automatic direction-reversing device, the other end of the mechanically-controlled automatic direction-reversing device is connected with the power cylinder in the center of the case, the fastening connector is connected with the case and further connected through pressure with the reversing valve successively, the power cylinder disposed in the case is a multi-stage power cylinder, said pressurizing cylinder communicates with a two-channel drill bit through the ultrahigh-pressure connecting tube which is in the center of the case, an ultrahigh-pressure channel is provided on the wall of the pressurizing cylinder, a section of enlarged shoulder hole which is a thin-wall tube is disposed in the ultrahigh-pressure connecting tube, the reversing valve comprising a plug-in reversing valve and a pilot valve, the upper end of the plug-in reversing valve is connected with the fastening connector, the lower end of the plug-in reversing valve is connected with the upper end of the pilot valve, and a valve core in the lower end of the pilot valve is connected with the mechanically-controlled automatic direction-reversing device, a control channel of the plug-in reversing valve is connected with an outlet of the pilot valve flow channel, a main flow channel of the plug-in reversing valve communicates with the power cylinder though the pilot valve.

2. A hydraulic automatically-pressurizing pump according to claim 1, wherein the mechanically-controlled automatic direction-reversing device comprising:

an elongated rod with a through hole in the center;

a position-limiting sleeve provided at the end of the elongated rod;

a spring element provided at the end of the elongated rod.

3. A hydraulic automatically-pressurizing pump according to claim 1, wherein the mechanically-controlled automatic direction-reversing device comprising:

an elongated rod with a through hole in the center;

a position-limiting sleeve provided at the end of the elongated rod;

a spring element provided at the end of the elongated rod.

4. A hydraulic automatically-pressurizing pump according to claim 2, wherein the reversing valve is a two-position four-way reversing valve with a positioning mechanism provided in the valve core, and a central through hole in the valve core communicates with a check discharge valve; small holes disposed in the valve core communicates with an annular space formed by the valve body and the elongated rod, and the central through hole of the valve core communicates with the through hole of the elongated rod.

5. A hydraulic automatically-pressurizing pump according to claim 3, wherein the plug-in reversing valve is a two-position four-way reversing valve with a positioning mechanism provided in valve core, and a central through hole in the valve core communicates with a check discharge valve; small holes disposed in the valve core of the pilot valve communicates with an annular space formed by the valve body and the elongated rod, and the central through hole of the valve core of the pilot valve communicates with the through hole of the elongated rod.

6. A hydraulic automatically-pressurizing pump according to claim 1, wherein position-limiting shoulders are respectively provided at the upper and lower ends in a hole of a hollow piston rod of the first-stage power cylinder.

7. A hydraulic automatically-pressurizing pump according to claim 1, wherein small holes for forming flow channels which permit liquid to reach the lower cavity of the power cylinder are provided longitudinally on the wall of the power cylinder;

small holes for forming flow channels which permit liquid to reach the upper cavity of the second or further stage power cylinders are provided longitudinally on the wall of a hollow piston rod of the power cylinder.

8. A hydraulic automatically-pressurizing pump according to claim 1, wherein an inlet check valve is provided at the lower end of the pressurizing cylinder;

a discharge check valve is disposed in the center of a piston in the pressurizing cylinder.

9. A hydraulic automatically-pressurizing pump according to claim 1, wherein the piston rod of the pressurizing cylinder has the same diameter as the piston rod in the lower cavity of the last stage power cylinder.

10. A hydraulic automatically-pressurizing pump according to claim 1, wherein a side flow channel is disposed between the reversing valve, the power cylinder, the pressurizing cylinder and the case, connecting with an ordinary nozzle of the two-channel drill bit.

11. A hydraulic automatically-pressurizing pump according to claim 1, wherein a check discharge valve is provided at one side or both sides of the said reversing valve.

12. A hydraulic automatically-pressurizing pump according to claim 1, wherein a filtering net is provided at the inlet of the reversing valve and the pressurizing cylinder respectively.

13. A hydraulic automatically-pressurizing pump according to claim 1, wherein a check valve is provided at the upper end of the ultrahigh-pressure connecting tube; a check valve is provided at the lower end of the side flow channel.

14. A hydraulic automatically-pressurizing pump according to claim 1, wherein a side flow channel is disposed between the plug-in reversing valve, the pilot valve, the power cylinder, the pressurizing cylinder and the case, connecting with an ordinary nozzle of the two-channel drill bit.

* * * * *